US006668152B1

(12) United States Patent
Jacob

(10) Patent No.: US 6,668,152 B1
(45) Date of Patent: Dec. 23, 2003

(54) TEXTURED FUSER ROLLER AND METHOD FOR TEXTURING TONER

(75) Inventor: Steve A. Jacob, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/243,435

(22) Filed: Sep. 13, 2002

(51) Int. Cl.[7] ..... G03G 15/20

(52) U.S. Cl. ..... 399/333; 219/216; 430/124; 492/30

(58) Field of Search ..... 399/320, 330, 399/333; 492/28–37; 432/60; 219/216; 430/99, 124

(56) References Cited

U.S. PATENT DOCUMENTS

| | | | | |
|---|---|---|---|---|
| 4,363,862 A | * | 12/1982 | Giorgini | 430/98 |
| 5,649,273 A | * | 7/1997 | Shimizu et al. | 399/333 |
| 5,753,348 A | * | 5/1998 | Hatakeyama et al. | 399/320 |
| 6,144,819 A | * | 11/2000 | Nishiuwatoko | 399/176 |

* cited by examiner

*Primary Examiner*—Joan Pendegrass

(57) ABSTRACT

Disclosed is a fuser roller having a textured outer surface. The textured outer surface can be used to produce a textured appearance on toner as it is fused to print media. Another embodiment of the invention is directed to a method that includes texturing the toner as it is fused to the print media. Texturing the toner helps mask gloss differential.

15 Claims, 4 Drawing Sheets

TEXTURED FUSER ROLLER AND METHOD FOR TEXTURING TONER

FIELD OF THE DISCLOSURE

The present disclosure relates to fusing toner to print media. More particularly, the disclosure relates to a fuser roller having a textured surface and a method for texturing toner to mask toner gloss differential.

BACKGROUND

Electrophotographic imaging devices such as printers and photocopiers typically are provided with fusing systems that thermally fuse a toner image onto a print media, such as sheets of paper. Such fusing systems normally comprise a heated fuser roller and a pressure roller that presses against the fuser roller to form a nip in which the fusing occurs. The fuser and pressure rollers typically comprise hollow metal tubes that are surrounded with outer lavers of material.

High-end electrophotographic imaging devices normally include fusing systems in which one or more of the rollers are surrounded with an outer layer composed of a heat resistant, highly compliant material. such as silicon rubber. In that such fusing systems are relatively expensive, lower-end electrophotographic imaging devices typically include fusing systems that use less expensive materials. For example, such devices may comprise fusing systems in which one or both of the rollers are surrounded with a relatively inelastic polymeric material, such as a polyester material (e.g., mylar).

Although such materials are resistant to heat, they are less effective in terms of facilitating fusing of toner to print media. As is known in the art, most print media are non-uniform across their outer surfaces. For example, sheets of paper normally include depressions and high points that result from the fibers contained within the paper and the process used to form the sheets. When such print media pass through the nip of a fusing system, the toner particles within the depressions receive less pressure and, therefore, may not fully fuse to the media. Incomplete fusing results in relatively glossy and non-glossy (i.e., matte) portions of toner on the print media. In other words, a gloss differential is formed across the toner printed on the media.

Substantial gloss differential is undesirable from an aesthetics perspective. In particular, when light reflects off of the toner and into the eyes of the observer, the non-uniformity of the toner can be obvious and detract from the print or photo copy job. This is particularly the case where an image has been printed or copied in that more toner covers the media.

Although gloss differential can be reduced by using more compliant materials for the roller outer layers, as noted above the materials may be too expensive for inclusion in lower-end devices. More even fusing could, at least theoretically speaking, be obtained if greater pressure were used to squeeze the print media as the media pass through the nip. Practically speaking, however, there are limitations as to how firmly the rollers can be pressed together without causing undue flexion of the rollers, which ultimately could result in even less uniform pressure being applied to the media.

From the foregoing, it can be appreciated that it would be desirable to have a fusing system with which gloss differential can be masked so as to improve the aesthetics of print or photocopy jobs output from imaging devices having relatively noncompliant fusing system rollers.

SUMMARY

Accordingly, one embodiment of the invention is directed to a fuser roller having a textured outer surface. The textured outer surface can be used to produce a textured appearance on toner as it is fused to print media. Another embodiment of the invention is directed to a method that includes texturing the toner as it is fused to the print media. Texturing the toner helps mask gloss differential.

BRIEF DESCRIPTION OF THE DRAWINGS

The following drawings are provided to support the present disclosure. The components in the drawings are not necessarily to scale.

DETAILED DESCRIPTION

Figure 1:
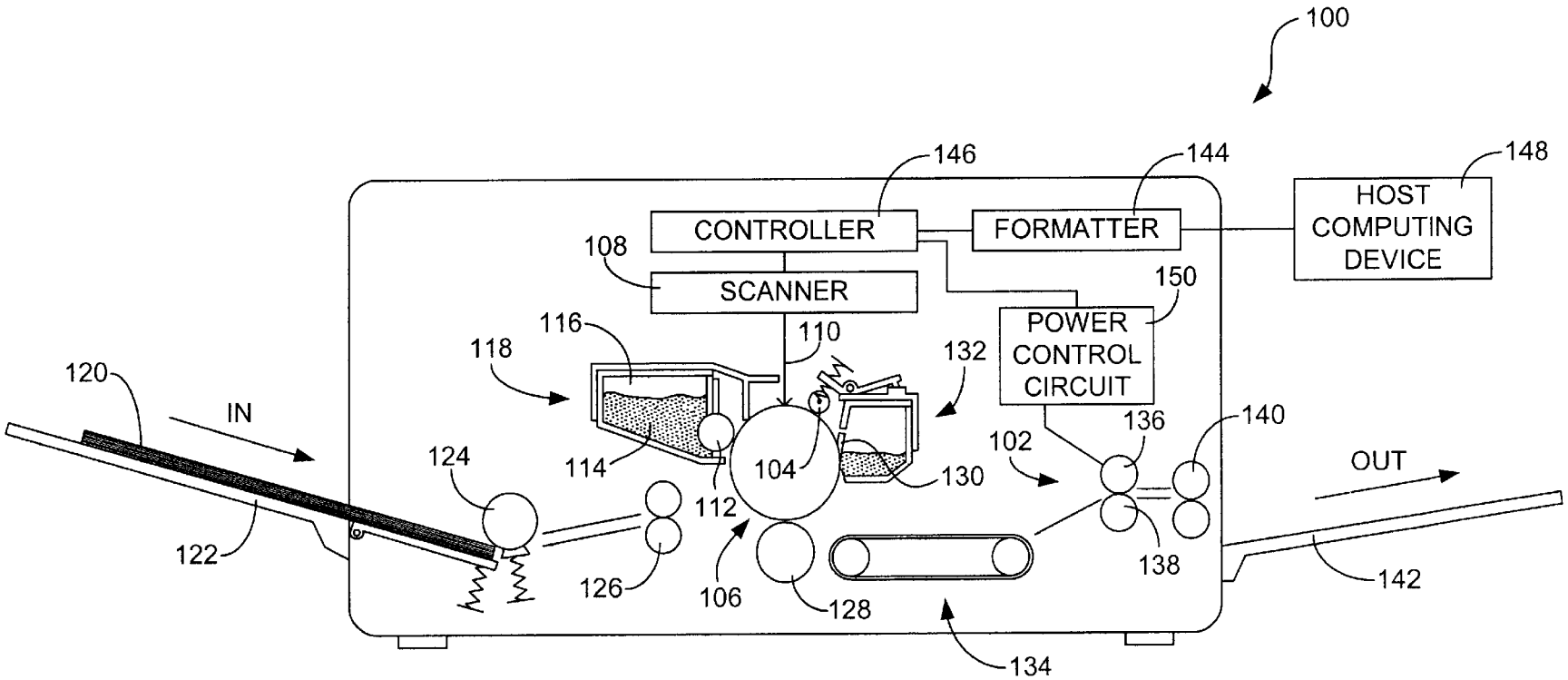
FIG. 1 is a schematic side view of an electrophotographic imaging device incorporating a fusing system that helps mask glass differential.

Referring now in more detail to the drawings, in which like numerals indicate corresponding parts throughout the several views, FIG. 1 illustrates a schematic side view of an electrophotographic imaging device 100 that incorporates a fusing system 102. By way of example, the device 100 comprises a laser printer. It is to be understood, however, that the device 100 can, alternatively, comprise any other imaging device that uses a fusing system including, for instance, a photocopier, a facsimile machine or a multifunction peripheral (MFP) device.

As indicated in FIG. 1, the device 100 includes a charge roller 104 that is used to charge the surface of a photoconductor drum 106 to a predetermined level. A laser diode (not shown) is provided within a laser scanner 108 that emits a laser beam 110 that is modulated as it is swept across the surface of the photoconductor drum 106 to selectively discharge the surface of the photoconductor drum. In the orientation shown in FIG. 1, the photoconductor drum 106 rotates in the counterclockwise direction. A developing roller 112 is used to develop a latent electrostatic image residing on the surface of photoconductor drum 106 after the surface of the photoconductor drum has been selectively discharged. Toner 114 is stored in a toner reservoir 116 of an electrophotographic print cartridge 118. The developing roller 112 includes an internal magnet (not shown) that magnetically attracts the toner 114 from the print cartridge 118 to the surface of the developing roller. As the developing roller 112 rotates (clockwise in FIG. 1), the toner 114 is attracted to the surface of the developing roller 112 and is then transferred across the gap between the surface of the photoconductor drum 106 and the surface of the developing roller to develop the latent electrostatic image.

Print media 120, for instance sheets of paper, are loaded from an input tray 122 by a pickup roller 124 into a conveyance path of the device 100. Each print medium 120 is individually drawn through the device 100 along the conveyance path by drive rollers 126 such that the leading edge of each print medium is synchronized with the rotation of the region on the surface of the photoconductor drum 106 that comprises the latent electrostatic image. As the photoconductor drum 106 rotates, the toner adhered to the discharged areas of the drum contacts the print medium 120, which has been charged by a transfer roller 128, such that the medium attracts the toner particles away from the surface of the photoconductor drum and onto the surface of the medium. Typically, the transfer of toner particles from the surface of the photoconductor drum 106 to the surface of the print medium 120 is not completely efficient. Therefore, some toner particles remain on the surface of the photoconductor drum. As the photoconductor drum 106 continues to rotate, the toner particles that remain adhered to the drum surface are removed by a cleaning blade 130 and are deposited in a toner waste hopper 132.

As the print medium 120 moves along the conveyance path past the photoconductor drum 106, a conveyer 134 delivers the print medium to the fusing system 102. The print medium 120 passes between a fuser roller 136 and a pressure roller 138 of the fusing system 102 that are described in greater detail below. As the pressure roller 138 rotates, the fuser roller 136 is rotated and the print medium 120 is pulled between the rollers. Heat and pressure applied to the print medium 120 as it passes between the rollers 136 and 138 fuses the toner to the surface of the print medium. Finally, output rollers 140 convey the print medium 120 from fusing system 102 and deliver it to an output tray 142.

As identified in FIG. 1, the device 100 also includes a formatter 144 and a controller 146. The formatter 144 receives print data, such as a display list, vector graphics, or raster print data, from a print driver operating in conjunction with an application program of a separate host computing device 148. The formatter 144 converts the print data into a stream of binary print data and sends the data to the controller 146. In addition, the formatter 144 and the controller 146 exchange data necessary for controlling the electrophotographic imaging process. In particular, the controller 146 supplies the stream of binary print data to the laser scanner 108. The binary print data stream sent to the laser diode within the laser scanner 108 modulate the laser diode to create the latent electrostatic image on the photoconductor drum 106.

In addition to providing the binary print data stream to the laser scanner 108, the controller 146 controls a high voltage power supply (not shown) that supplies voltages and currents to the components used in the device 100 including the charge roller 104, the developing roller 112, and the transfer roller 128. The controller 146 further controls a drive motor (not shown) that drives the printer gear train (not shown) as well as the various clutches and feed rollers (not shown) necessary to move print media 120 through the conveyance path of the device 100.

A power control circuit 150 controls the application of power to the fusing system 102. While the device 100 is waiting to begin processing a print or photo copy job, the temperature of the fusing system 102 is kept at a standby temperature corresponding to a standby mode. In the standby mode, power is supplied at a reduced level to the fusing system 102 by the power control circuit 150 to reduce power consumption, lower the temperature, and reduce the system degradation.

When processing of a fusing job begins, the controller 146, sufficiently ahead of the arrival of a print medium 120 at the fusing system 102, increases the power supplied by the power control circuit 150 to the fusing system to bring its temperature up to the fusing temperature. After completion of the fusing job, the controller 146 sets the power control circuit 150 to reduce the power supplied to the fusing system to a level corresponding to the standby mode. The cycling of the power supplied to the fusing system 102 is ongoing during operation of the device 100 as fusing jobs are received and processed and while the device is idle.

Figure 2:
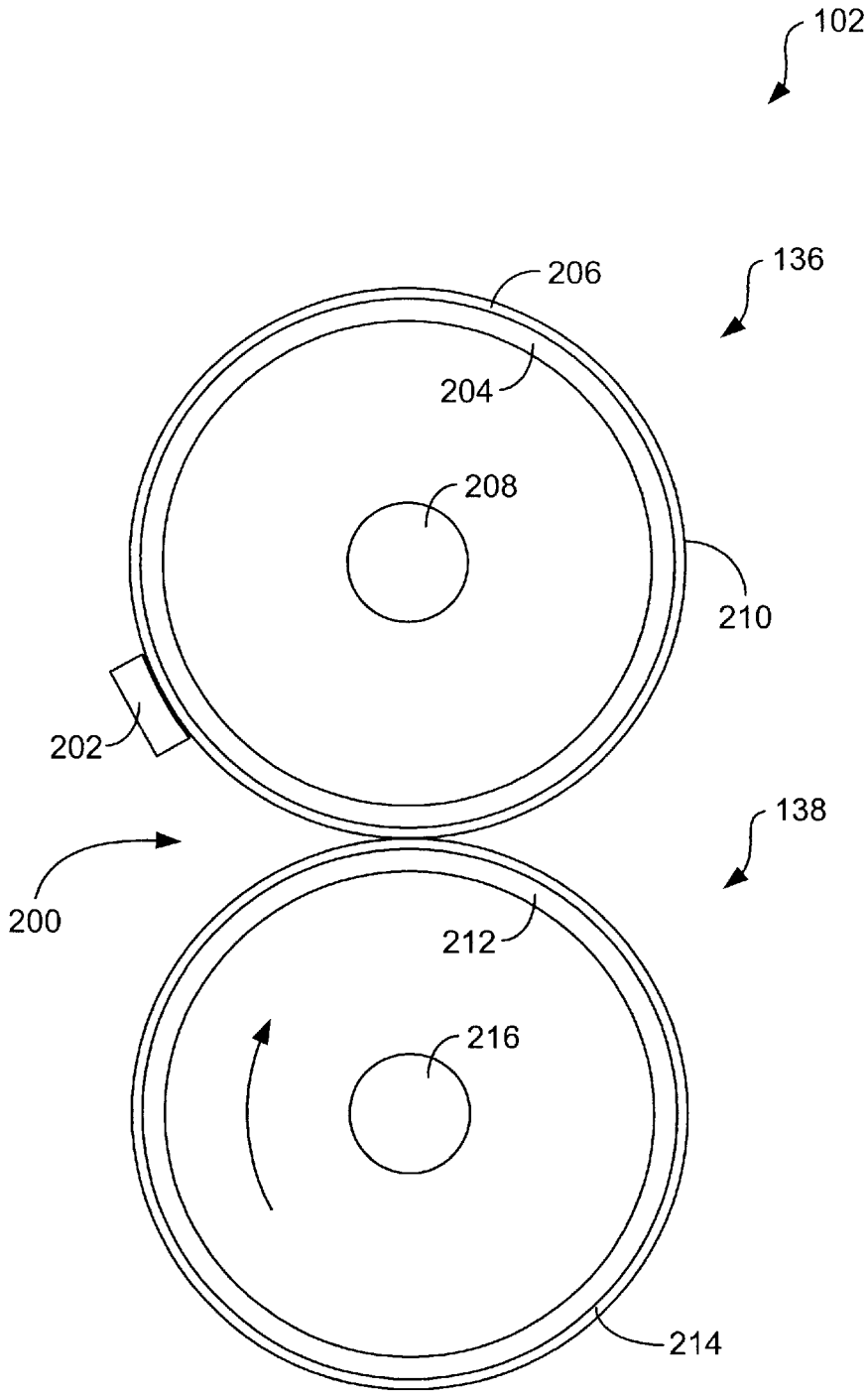
FIG. 2 is a detailed view of the fusing system shown in FIG. 1.

FIG. 2 illustrates a detailed end view of the fusing system 102 shown in FIG. 1. As indicated in FIG. 2, the fusing system 102 comprises the fuser roller 136 and the pressure roller 138 that together form a nip 200 therebetween. In addition, the fusing system 102 can include a temperature sensor 202 that is associated with, for example, the fuser roller 136.

The fuser roller 136 typically is formed as a hollow tube 204. By way of example, the tube 204 is composed of a metal such as aluminum or steel and has a diameter of approximately 45 millimeters (mm). By further way of example, the tube 204 has a thickness of approximately 2.5 mm. The fuser roller 136 includes an outer layer 206 that has a thickness of, for instance, approximately 4 mm. As is described in greater detail below, an outer surface 210 of the outer layer 206 is provided with a textured pattern that transfers a similar (mirror image) pattern to toner fused to the print media as the media pass through the fusing system 102. As explained, the provision of such a pattern helps mask toner gloss differential that may be present across the media. Although the textured pattern may be provided with any surface material, it is expected that the greatest benefit is achieved by providing the textured pattern on an outer layer 206 made of relatively inelastic polymeric material such as is used with lower end printing devices. To prevent toner from adhering to the outer layer 206, a coating (not visible in FIG. 2) of nonstick material, such as polytetrafluoroethylene (PTFE), can be applied to the outer surface 210 of the outer layer. This nonstick coating can, for instance, have a thickness of approximately 1.5 to 2 mils. In that it is so thin, the coating does not occlude the texture of the outer layer 206.

Provided within the fuser roller 136 is an internal heating element 208 that, by way of example, comprises a halogen lamp or a nichrome heating element. It is to be noted that, although an internal heating element 208 is shown and described, the fuser roller 136 could, alternatively, be provided with an external heat source, or without any heat source at all, if desired.

The pressure roller 138 can comprise, for instance, a hollow metal tube 212 that is provided with an outer layer 214 of polymeric material. As with the fuser roller 136, the pressure roller 138 may be provided with a coating (not visible in FIG. 2) of nonstick material, such as PTFE. Optionally provided within the pressure roller 138 is an internal heating element 216 that, by way of example, comprises a halogen lamp or a nichrome heating element. Alternatively, the pressure roller 138 can be configured without its own heat source. Provision of a heat source may, however, prevent the accumulation of toner on the pressure roller 138.

The temperature sensor 202 typically comprises a thermistor that is placed in close proximity to or in contact with the fuser roller 136 at a position adjacent the entry of the nip 200. Although this placement is preferred, it will be appreciated that other placement is also feasible. In an alternative arrangement, the sensor 202 can comprise a non-contact thermopile (not shown). Although non-contact thermopiles are preferable from the standpoint of reliability, they are more expensive and therefore increase the cost of the device 100.

Figure 3:
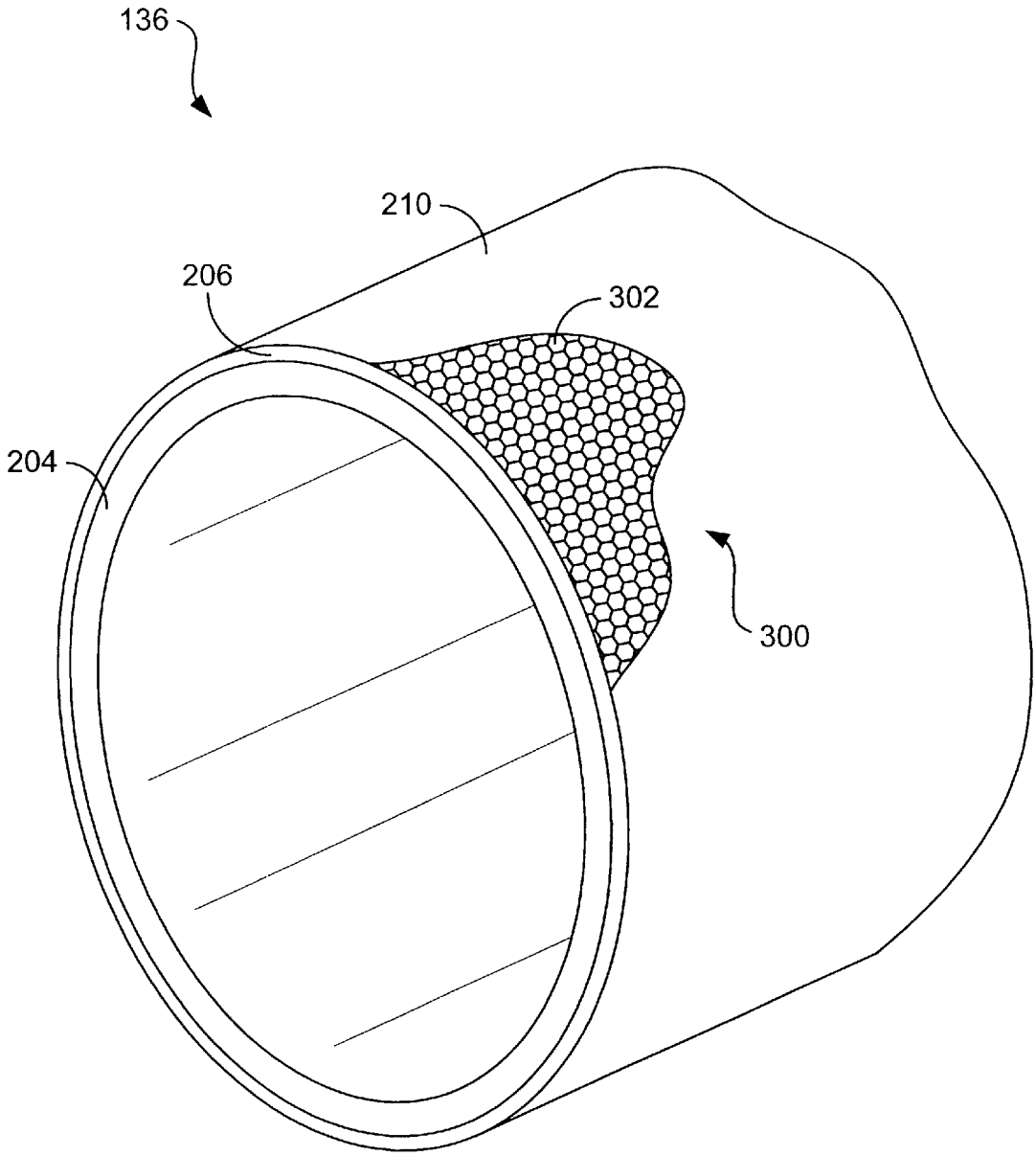
FIG. 3 is partial perspective view of a fuser roller of the fusing system shown in FIG. 2.
Figure 4:
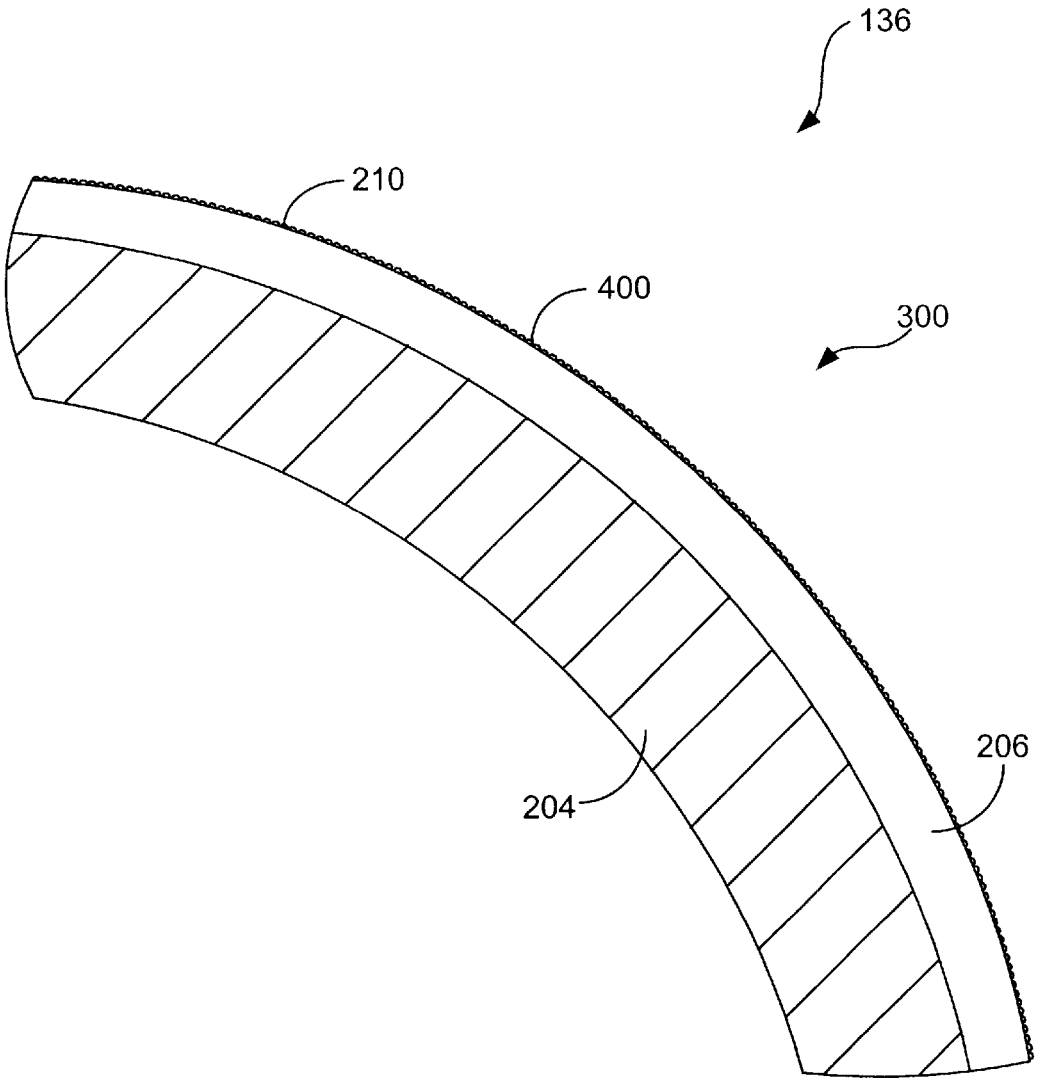
FIG. 4 is a partial, cross-sectional end view of the fuser roller shown in FIG. 3.

The fuser roller 136 is illustrated in greater detail in FIGS. 3 and 4. As indicated in FIG. 3, the outer surface 210 of the outer layer 206 of the fuser roller 136 comprises a textured pattern 300 (although only a portion of the pattern is indicated in FIG. 3, the entire outer surface 210 is preferably textured) that comprises a plurality of repeated elements 302. The nature of the elements 302 can be varied depending upon the desired result. Preferably, however, the elements 302 are small, for instance approximately 0.01–10 square millimeters in area, such that a high frequency pattern results. As will be appreciated by persons having ordinary skill in the art patterns with smaller areas may mask the gloss differential better by producing a matte appearance. By way of example, as shown in FIG. 3, the textured pattern 300 can comprise repeating geometric shapes such as honeycombs. Other geometric shapes can be used including rectangles, triangles, diamonds, circles, etc.

In an alternative embodiment, the textured pattern 300 comprise an asymmetric, non-geometric pattern such as a paisley pattern. Asymmetric patterns may be preferable in that their seemingly non-repetitive nature may be better for masking gloss differential. Another example of an asymmetric pattern is a pattern of simulated brush strokes. Such a pattern may be particularly preferable for printing images such as photographs, drawings, or paintings.

As indicated in FIG. 4, the textured pattern 300 can be created by forming a plurality of protrusions 400 on the outer surface 210 of the outer layer 206 of the fusing roller 136. Alternatively, however, the pattern 300 can be created by forming a plurality of impressions on the outer surface 210. In either case, however, the pattern 300 can be created through a commonly known molding process (e.g., injection molding).

In operation, the fuser and pressure rollers 136 and 138 are heated by the provided heating elements (e.g., internal heating elements 208 and 216). Once the fusing system 102 is heated to operating temperature, print media (e.g., paper) can be passed through the nip 200 such that the toner side faces the fuser roller 136 and, therefore, the textured pattern 300. As the media pass through the nip 200, the toner is fused to the media. Due to the provision of the textured pattern 300, a mirror image of the pattern is imprinted or embossed into the fused toner so as to provide a visible pattern to the toner. As noted above, where the roller are relatively non-compliant toner gloss differential may result. However, the pattern transferred to the toner masks such gloss differential and, therefore, provides a more aesthetically pleasing result. In particular, when the printed media (e.g., printed page) are viewed such that light is reflected into the eyes of the observer, the observer's eyes will register the transferred pattern more readily than the gloss differential.

While particular embodiments of the fusing system and its operation have been disclosed in detail in the foregoing description and drawings for purposes of example, it will be understood by those skilled in the art that variations and modifications thereof can be made without departing from the scope of the invention as set forth in the following claims.

What is claimed is:

1. A fuser roller for an imaging device having a textured outer surface having a high frequency pattern of repeated protrusions that comprise geometric shapes.

2. The fuser roller of claim 1, wherein the geometric shapes comprise at least one of a rectangle, a triangle, a diamond, a honeycomb, and a circle.

3. fuser roller, comprising:

a metal tube; and a layer of polymeric material formed on the metal tube, the layer of polymeric material having a textured outer surface having a high frequency pattern of repeated protrusions.

4. The fuser roller of claim 3, wherein the repeated protrusions comprise geometric shapes that comprise at least one of a rectangle, a triangle, a diamond, a honeycomb, and a circle.

5. A fusing system, comprising:

a first roller having a textured outer surface having a high frequency pattern of repeated protrusions that comprise geometric shapes; and a second roller having an outer surface that engages the outer surface of the first roller.

6. The fusing system of claim 5, wherein the geometric shapes comprise at least one of a rectangle, a triangle, a diamond, a honeycomb, and a circle.

7. The fusing system of claim 5, wherein the fuser roller comprises a metal tube surrounded by an inelastic polymeric outer layer, the outer layer comprising the textured outer surface.

8. The fusing system of claim 7, wherein the outer layer is coated with a non-stick coating.

9. A fusing system for fusing toner to print media in an electrophotographic imaging device, the fusing system comprising:

a fuser roller including a metal tube and an inelastic polymeric outer layer, the outer layer having a textured outer surface that forms a high frequency pattern of repeated protrusions; and a pressure roller that is in contact with the fuser roller so as to form a nip therebetween.

10. An electrophotographic imaging device, comprising:

a photoconductor drum;

a charge roller positioned adjacent the photoconductor drum that provides a charge to the drum;

a laser scanner that selectively discharges portions of the photoconductor drum;

a developing roller that develop latent electrostatic images on the photoconductor drum;

fusing system including a fuser roller having a textured outer surface that forms a high frequency pattern of repeated protrusions that produces a textured appearance on toner that is fused to print media; and a pressure roller.

11. A method for masking gloss differential on printed media, comprising:

attracting toner to print media;

fusing the toner to the print media using a textured outer layer of a roller including a plurality of repeated protrusions; and texturing the fused toner so as to comprise a high frequency pattern of repeated shapes.

12. The method of claim 11, wherein fusing and texturing are performed simultaneously.

13. The method of claim 11, wherein texturing comprises patterning the fused toner with geometric shapes.

14. A fuser roller for an imaging device, the fuser roller having a textured outer surface that comprises at least one of paisleys and simulated brush-strokes.

15. A fusing system, comprising:

a first roller having a textured outer surface that comprises at least one of paisleys and simulated brush-strokes; and a second roller having an outer surface that engages the outer surface of the first roller.

* * * * *

UNITED STATES PATENT AND TRADEMARK OFFICE

CERTIFICATE OF CORRECTION

PATENT NO. : 6,668,152 B1
DATED : December 23, 2003
INVENTOR(S) : Steve A. Jacob It is certified that error appears in the above-identified patent and that said Letters Patent is hereby corrected as shown below:

Column 5,
Line 62, delete "fuser roller," and insert -- A fuser roller, --

Column 6,
Line 39, delete "fusing system" and insert therefor -- a fusing system --

Signed and Sealed this

Twenty-sixth Day of July, 2005

JON W. DUDAS
*Director of the United States Patent and Trademark Office*